US007903130B2

(12) United States Patent
Lin et al.

(10) Patent No.: US 7,903,130 B2
(45) Date of Patent: Mar. 8, 2011

(54) DRIVING METHOD FOR INCREASING GRAY LEVEL

(75) Inventors: Chia-Lang Lin, Hsinchu (TW); Yu-Cheng Chang, Taichung (TW)

(73) Assignee: Sitronix Technology Corp., Hsinchu Hsien (TW)

( * ) Notice: Subject to any disclaimer, the term of this patent is extended or adjusted under 35 U.S.C. 154(b) by 1284 days.

(21) Appl. No.: 11/414,171

(22) Filed: May 1, 2006

(65) Prior Publication Data

US 2007/0252802 A1 Nov. 1, 2007

(51) Int. Cl.
*G09G 5/10* (2006.01)

(52) U.S. Cl. ..... 345/691; 345/89

(58) Field of Classification Search ..... 345/691, 345/89, 87, 55

See application file for complete search history.

(56) References Cited

U.S. PATENT DOCUMENTS

2005/0057466 A1* 3/2005 Sala et al. ..... 345/87
2007/0229423 A1* 10/2007 Tyrrell ..... 345/89

* cited by examiner

*Primary Examiner* — Amr Awad
*Assistant Examiner* — Leonid Shapiro
(74) *Attorney, Agent, or Firm* — Rosenberg, Klein & Lee

(57) ABSTRACT

The present invention discloses a driving method for increasing gray level, wherein the PWM mode is added into the FRM mode, and the PWM mode is implemented with the common drive circuit; the section of the horizontal synchronous signal of a frame interval is divided into multiple sub-sections according to the requirement of the PWM mode; the control of the length of the turn-on period within a frame interval is implemented with a redesigned control circuit, and none special drive circuit is needed.

3 Claims, 7 Drawing Sheets

16FRM+3PWM (31 gray density)

| gray level | Base | FRM density | density | Delta density | PWM f0 | PWM f1 | 1 | 2 | 3 | 4 | 5 | 6 | 7 | 8 | 9 | 10 | 11 |
|---|---|---|---|---|---|---|---|---|---|---|---|---|---|---|---|---|---|
| 30 | 11 | 11/11 | 1.000 | | 1 | 2 | 2 | 2 | 2 | 2 | 2 | 2 | 2 | 2 | 2 | 2 | 2 |
| 29 | 11 | 10/11 | 0.955 | 0.045 | 1 | 2 | 2 | 2 | 2 | 2 | 2 | 2 | 2 | 2 | 2 | 2 | 1 |
| 28 | 7 | 6/7 | 0.929 | 0.026 | 1 | 2 | 2 | 2 | 2 | 2 | 2 | 2 | 1 | | | | |
| 27 | 5 | 4/5 | 0.900 | 0.029 | 1 | 2 | 2 | 2 | 2 | 2 | 1 | | | | | | |
| 26 | 7 | 5/7 | 0.857 | 0.043 | 1 | 2 | 2 | 2 | 2 | 2 | 2 | 1 | 1 | | | | |
| 25 | 3 | 2/3 | 0.833 | 0.024 | 1 | 2 | 2 | 2 | 1 | | | | | | | | |
| 24 | 5 | 3/5 | 0.800 | 0.033 | 1 | 2 | 2 | 2 | 2 | 1 | 1 | | | | | | |
| 23 | 11 | 6/11 | 0.773 | 0.027 | 1 | 2 | 2 | 2 | 2 | 2 | 2 | 2 | 1 | 1 | 1 | 1 | 1 |
| 22 | 11 | 5/11 | 0.727 | 0.045 | 1 | 2 | 2 | 2 | 2 | 2 | 2 | 1 | 1 | 1 | 1 | 1 | 1 |
| 21 | 5 | 2/5 | 0.700 | 0.027 | 1 | 2 | 2 | 2 | 1 | 1 | 1 | | | | | | |
| 20 | 3 | 1/3 | 0.667 | 0.033 | 1 | 2 | 2 | 1 | 1 | | | | | | | | |
| 19 | 7 | 2/7 | 0.643 | 0.024 | 1 | 2 | 2 | 2 | 1 | 1 | 1 | 1 | 1 | | | | |
| 18 | 5 | 1/5 | 0.600 | 0.043 | 1 | 2 | 2 | 1 | 1 | 1 | 1 | | | | | | |
| 17 | 7 | 1/7 | 0.571 | 0.029 | 1 | 2 | 2 | 1 | 1 | 1 | 1 | 1 | 1 | | | | |
| 16 | 11 | 1/11 | 0.545 | 0.026 | 1 | 2 | 2 | 1 | 1 | 1 | 1 | 1 | 1 | 1 | 1 | 1 | 1 |
| 15 | 11 | 11/11 | 0.500 | 0.045 | 0 | 1 | 1 | 1 | 1 | 1 | 1 | 1 | 1 | 1 | 1 | 1 | 1 |
| 14 | 11 | 10/11 | 0.455 | 0.045 | 0 | 1 | 1 | 1 | 1 | 1 | 1 | 1 | 1 | 1 | 1 | 1 | 0 |
| 13 | 7 | 6/7 | 0.429 | 0.026 | 0 | 1 | 1 | 1 | 1 | 1 | 1 | 1 | 0 | | | | |
| 12 | 5 | 4/5 | 0.400 | 0.029 | 0 | 1 | 1 | 1 | 1 | 1 | 0 | | | | | | |
| 11 | 7 | 5/7 | 0.357 | 0.043 | 0 | 1 | 1 | 1 | 1 | 1 | 1 | 0 | 0 | | | | |
| 10 | 3 | 2/3 | 0.333 | 0.024 | 0 | 1 | 1 | 1 | 0 | | | | | | | | |
| 9 | 5 | 3/5 | 0.300 | 0.033 | 0 | 1 | 1 | 1 | 1 | 0 | 0 | | | | | | |
| 8 | 11 | 6/11 | 0.273 | 0.027 | 0 | 1 | 1 | 1 | 1 | 1 | 1 | 1 | 0 | 0 | 0 | 0 | 0 |
| 7 | 11 | 5/11 | 0.227 | 0.045 | 0 | 1 | 1 | 1 | 1 | 1 | 1 | 0 | 0 | 0 | 0 | 0 | 0 |
| 6 | 5 | 2/5 | 0.200 | 0.027 | 0 | 1 | 1 | 1 | 0 | 0 | 0 | | | | | | |
| 5 | 3 | 1/3 | 0.167 | 0.033 | 0 | 1 | 1 | 0 | 0 | | | | | | | | |
| 4 | 7 | 2/7 | 0.143 | 0.024 | 0 | 1 | 1 | 1 | 0 | 0 | 0 | 0 | 0 | | | | |
| 3 | 5 | 1/5 | 0.100 | 0.043 | 0 | 1 | 1 | 0 | 0 | 0 | 0 | | | | | | |
| 2 | 7 | 1/7 | 0.071 | 0.029 | 0 | 1 | 1 | 0 | 0 | 0 | 0 | 0 | 0 | | | | |
| 1 | 11 | 1/11 | 0.045 | 0.026 | 0 | 1 | 1 | 0 | 0 | 0 | 0 | 0 | 0 | 0 | 0 | 0 | 0 |
| 0 | 11 | 0/11 | 0.000 | 0.045 | 0 | 1 | 0 | 0 | 0 | 0 | 0 | 0 | 0 | 0 | 0 | 0 | 0 |

Fig. 6

16FRM+4PWM (46 gray density)

| gray level | Base | FRM density | density | Delta density | PWM f0 | PWM f1 | 1 | 2 | 3 | 4 | 5 | 6 | 7 | 8 | 9 | 10 | 11 |
|---|---|---|---|---|---|---|---|---|---|---|---|---|---|---|---|---|---|
| 45 | 11 | 11/11 | 1.000 | | 2 | 3 | 3 | 3 | 3 | 3 | 3 | 3 | 3 | 3 | 3 | 3 | 3 |
| 44 | 11 | 10/11 | 0.970 | 0.030 | 2 | 3 | 3 | 3 | 3 | 3 | 3 | 3 | 3 | 3 | 3 | 3 | 2 |
| 43 | 7 | 6/7 | 0.952 | 0.017 | 2 | 3 | 3 | 3 | 3 | 3 | 3 | 3 | 2 | | | | |
| 42 | 5 | 4/5 | 0.933 | 0.019 | 2 | 3 | 3 | 3 | 3 | 3 | 2 | | | | | | |
| 41 | 7 | 5/7 | 0.905 | 0.029 | 2 | 3 | 3 | 3 | 3 | 3 | 3 | 2 | 2 | | | | |
| 40 | 3 | 2/3 | 0.889 | 0.016 | 2 | 3 | 3 | 3 | 2 | | | | | | | | |
| 39 | 5 | 3/5 | 0.867 | 0.022 | 2 | 3 | 3 | 3 | 3 | 2 | 2 | | | | | | |
| 38 | 11 | 6/11 | 0.848 | 0.018 | 2 | 3 | 3 | 3 | 3 | 3 | 3 | 3 | 2 | 2 | 2 | 2 | 2 |
| 37 | 11 | 5/11 | 0.818 | 0.030 | 2 | 3 | 3 | 3 | 3 | 3 | 3 | 2 | 2 | 2 | 2 | 2 | 2 |
| 36 | 5 | 2/5 | 0.800 | 0.018 | 2 | 3 | 3 | 3 | 2 | 2 | 2 | | | | | | |
| 35 | 3 | 1/3 | 0.778 | 0.022 | 2 | 3 | 3 | 2 | 2 | | | | | | | | |
| 34 | 7 | 2/7 | 0.762 | 0.016 | 2 | 3 | 3 | 3 | 2 | 2 | 2 | 2 | 2 | | | | |
| 33 | 5 | 1/5 | 0.733 | 0.029 | 2 | 3 | 3 | 2 | 2 | 2 | 2 | | | | | | |
| 32 | 7 | 1/7 | 0.714 | 0.019 | 2 | 3 | 3 | 2 | 2 | 2 | 2 | 2 | 2 | | | | |
| 31 | 11 | 1/11 | 0.697 | 0.017 | 2 | 3 | 3 | 2 | 2 | 2 | 2 | 2 | 2 | 2 | 2 | 2 | 2 |
| 30 | 11 | 11/11 | 0.667 | 0.030 | 2 | 3 | 2 | 2 | 2 | 2 | 2 | 2 | 2 | 2 | 2 | 2 | 2 |
| 29 | 11 | 10/11 | 0.636 | 0.030 | 1 | 2 | 2 | 2 | 2 | 2 | 2 | 2 | 2 | 2 | 2 | 2 | 1 |
| 28 | 7 | 6/7 | 0.619 | 0.017 | 1 | 2 | 2 | 2 | 2 | 2 | 2 | 2 | 1 | | | | |
| 27 | 5 | 4/5 | 0.600 | 0.019 | 1 | 2 | 2 | 2 | 2 | 2 | 1 | | | | | | |
| 26 | 7 | 5/7 | 0.571 | 0.029 | 1 | 2 | 2 | 2 | 2 | 2 | 2 | 1 | 1 | | | | |
| 25 | 3 | 2/3 | 0.556 | 0.016 | 1 | 2 | 2 | 2 | 1 | | | | | | | | |
| 24 | 5 | 3/5 | 0.533 | 0.022 | 1 | 2 | 2 | 2 | 2 | 1 | 1 | | | | | | |
| 23 | 11 | 6/11 | 0.515 | 0.018 | 1 | 2 | 2 | 2 | 2 | 2 | 2 | 2 | 1 | 1 | 1 | 1 | 1 |
| 22 | 11 | 5/11 | 0.485 | 0.030 | 1 | 2 | 2 | 2 | 2 | 2 | 2 | 1 | 1 | 1 | 1 | 1 | 1 |
| 21 | 5 | 2/5 | 0.467 | 0.018 | 1 | 2 | 2 | 2 | 1 | 1 | 1 | | | | | | |
| 20 | 3 | 1/3 | 0.444 | 0.022 | 1 | 2 | 2 | 1 | 1 | | | | | | | | |
| 19 | 7 | 2/7 | 0.429 | 0.016 | 1 | 2 | 2 | 2 | 1 | 1 | 1 | 1 | 1 | | | | |
| 18 | 5 | 1/5 | 0.400 | 0.029 | 1 | 2 | 2 | 1 | 1 | 1 | 1 | | | | | | |
| 17 | 7 | 1/7 | 0.381 | 0.019 | 1 | 2 | 2 | 1 | 1 | 1 | 1 | 1 | 1 | | | | |
| 16 | 11 | 1/11 | 0.364 | 0.017 | 1 | 2 | 2 | 1 | 1 | 1 | 1 | 1 | 1 | 1 | 1 | 1 | 1 |
| 15 | 11 | 11/11 | 0.333 | 0.030 | 0 | 1 | 1 | 1 | 1 | 1 | 1 | 1 | 1 | 1 | 1 | 1 | 1 |
| 14 | 11 | 10/11 | 0.303 | 0.030 | 0 | 1 | 1 | 1 | 1 | 1 | 1 | 1 | 1 | 1 | 1 | 1 | 0 |
| 13 | 7 | 6/7 | 0.286 | 0.017 | 0 | 1 | 1 | 1 | 1 | 1 | 1 | 1 | 0 | | | | |
| 12 | 5 | 4/5 | 0.267 | 0.019 | 0 | 1 | 1 | 1 | 1 | 1 | 0 | | | | | | |
| 11 | 7 | 5/7 | 0.238 | 0.029 | 0 | 1 | 1 | 1 | 1 | 1 | 1 | 0 | 0 | | | | |
| 10 | 3 | 2/3 | 0.222 | 0.016 | 0 | 1 | 1 | 1 | 0 | | | | | | | | |
| 9 | 5 | 3/5 | 0.200 | 0.022 | 0 | 1 | 1 | 1 | 1 | 0 | 0 | | | | | | |
| 8 | 11 | 6/11 | 0.182 | 0.018 | 0 | 1 | 1 | 1 | 1 | 1 | 1 | 1 | 0 | 0 | 0 | 0 | 0 |
| 7 | 11 | 5/11 | 0.152 | 0.030 | 0 | 1 | 1 | 1 | 1 | 1 | 1 | 0 | 0 | 0 | 0 | 0 | 0 |
| 6 | 5 | 2/5 | 0.133 | 0.018 | 0 | 1 | 1 | 1 | 0 | 0 | 0 | | | | | | |
| 5 | 3 | 1/3 | 0.111 | 0.022 | 0 | 1 | 1 | 0 | 0 | | | | | | | | |
| 4 | 7 | 2/7 | 0.095 | 0.016 | 0 | 1 | 1 | 1 | 0 | 0 | 0 | 0 | 0 | | | | |
| 3 | 5 | 1/5 | 0.067 | 0.029 | 0 | 1 | 1 | 0 | 0 | 0 | 0 | | | | | | |
| 2 | 7 | 1/7 | 0.048 | 0.019 | 0 | 1 | 1 | 0 | 0 | 0 | 0 | 0 | 0 | | | | |
| 1 | 11 | 1/11 | 0.030 | 0.017 | 0 | 1 | 1 | 0 | 0 | 0 | 0 | 0 | 0 | 0 | 0 | 0 | 0 |
| 0 | 11 | 0/11 | 0.000 | 0.030 | 0 | 1 | 0 | 0 | 0 | 0 | 0 | 0 | 0 | 0 | 0 | 0 | 0 |

Fig. 7

DRIVING METHOD FOR INCREASING GRAY LEVEL

FIELD OF THE INVENTION

The present invention relates to an LCD gray level drive technology, particularly to a driving method for increasing gray level, which adds the PWM mode into the FRM LCD mode.

BACKGROUND OF THE INVENTION

Liquid crystal is an organic compound between solid state and liquid state, and the molecules thereof are orderly arranged. When liquid crystal is heated, it is a transparent liquid; when liquid crystal is cooled, it becomes a cloudy crystalline solid. Owing to the abovementioned characteristic, such a compound is called liquid crystal. The principle of liquid crystal display (LCD) is: liquid crystal is encapsulated in a glass casing, and an electrical filed is applied to the liquid crystal to control its transparency and light permeability. Thus, whether a pixel of a LCD panel is lighting or not can be controlled.

The common LCD can be classified into: TN-LCD (Twisted Nematic LCD), STN-LCD (Super Twisted Nematic LCD), DSTN-LCD (Dual scan Super Twisted Nematic LCD), and TFT-LCD (Thin Film Transistor LCD). TN-LCD, STN-LCD, and DSTN-LCD have similar working principles, and the difference thereof is just in the molecular twist angle. The molecular twist angle of STN-LCD is greater than that of TN-LCD and reaches 180 degrees or even 270 degrees. STN-LCD can be applied to electronic products having a lager display panel, such as electronic dictionaries, entertainment electronic products, personal digital assistants (PDA), mobile phones, and lower grade notebook computers.

Refer to FIG. 1 a diagram schematically showing the electrodes of a general STN-LCD panel. The X electrode group consisting of electrodes X1~Xn vertically crosses the Y electrode group consisting of electrodes Y1~Yn to form matrix-like intersections, and each intersection represents a pixel of the panel. The common drive circuit one-by-one scans the electrodes arranged in Y direction, and the scanning speed must be faster than the photogene of human eyes lest the picture appear flickering. According to the data coming from the LCD control circuit, the segment drive circuit sends different voltages to the electrodes arranged in the X direction, and whether a pixel is lighting depends on the potential difference of the electrodes intersected at the pixel.

The common signal respectively has a maximum voltage and a minimum voltage in the positive frame interval and the negative frame interval, and the segment circuit sends out the voltage levels of the display data to determine whether to turn on the pixel.

To enable that LCD can present the effect of gray levels, sophisticated signals are used to drive liquid crystal molecules, and different grades of gray levels will thus appear under the photogene effect of human eyes. The common LCD gray-level technologies include: the FRM (Frame Rate Modulation) mode and the PWM (Pulse Width Modulation) mode.

In the FRM mode, the gray level depends on the number of the turn-on frames among N frames per second. For example, suppose there are N frames per second in a monochromatic display; if a pixel is intended to be full white, the pixel should be turned on N times per second. The principle of controlling the gray level via the FRM mode is to control the turn-on number per second of a pixel to determine the ratio of the turn-on frames to N frames per second; thus, the gray level is determined by the turn-on ratio. Refer to FIG. 2 a diagram showing the relation between the gray-level effects (G0~G3) and the number of the turn-on frames per second when there are three frames (FR0~FR2) per second (4FRMA—4 gray-level FRM mode). If the pixel is turned on 3 times, the pixel will be full white (of G3 gray level); if the pixel is turned on 0 time, the pixel will be black (of G0 gray level).

Such a mode only varies the turn-on number of frames; therefore, only the LCD control circuit needs changing, and it is unnecessary to change the LCD drive circuit. The key point of the FRM mode is the frame frequency, i.e. the number of the frames per second; the displaying speed of the frames must be faster than the photogene of human eyes and is usually within 42~140 Hz; otherwise, flickering phenomenon will appear. In the FRM mode, to achieve an effective gray-level effect, the displaying time of each pixel should be increased to accumulate enough light for photogene, and the frequency overlap with the background light should be prevented also.

In the PWM mode, the gray level is controlled via adjusting the length of the turn-on period within each frame interval. For example, in the PWM mode, if the frame frequency is N frames per second, a pixel will be turned on N times per second; however, only a portion of a frame interval will be turned on, and the gray level depends on the proportion of the turn-on portion within a frame interval.

Refer to FIG. 3 a diagram showing the 3PWM in SEG mode with the horizontal synchronous signal Hsync and the vertical synchronous signal Vsync of the same frequency. In 3PWM mode, a frame interval is divided into two sub-sections; thus, according to the combination of the turn-on and non-turn-on states of those two sub-sections within a frame interval, a pixel may have three gray-level states: non-turn-on, half turn-on, and full turn-on, and FIG. 3 shows that a frame interval is half turned on. The PWM mode needs to adjust the output timing of the drive circuit; therefore, both the original LCD control circuit and the original LCD drive circuit need changing, i.e. the original segment drive circuit has to be replaced with a specially designed segment drive circuit; thus, the complexity and cost of the circuit will be considerably increased.

SUMMARY OF THE INVENTION

The primary objective of the present invention is to add a PWM mode into the FRM mode so that the gray level of pixels can be increased under the condition of low frame frequency, and it is unnecessary to change the original LCD drive circuit.

Another objective of the present invention is to increase the gray level of pixels under the condition of low frame frequency via adding the PMW mode into the FRM mode so that pixel flickering can be avoided, crosstalk effect can be reduced, drive-element output can be stabilized, panel life can be increased, and display quality can be promoted.

In the present invention, the PWM mode is added into the original FRM mode, and the PWM mode is implemented with the common drive circuit, which scans the Y-direction electrodes. The segment drive circuit sends different voltages to the X-direction electrodes according to the data coming from the LCD control circuit. Each section of the horizontal synchronous signal of a frame interval is divided into multiple sub-sections according to the requirement of the PWM mode. The LCD control circuit can control the common signal to vary the length of the turn-on period within a frame interval. In this case, it is unnecessary to change the LCD drive circuit.

In the present invention, the turn-on sub-sections of the PWM mode are allocated to the neighboring non-turn-on frames via the LCD control circuit. Thus, the turn-on sub-sections are well weighted and distributed to the neighboring non-turn-on frames, but the total time length of the turn-on sub-sections for a given number of frames is maintained to meet the required gray level. As the time length of a turn-on period and the time length of a non-turn-on period are both shortened, the time-related well-weighted PWM turn-on mode of the present invention can have the speed faster than that of the photogene of human eyes and reduce the flickering phenomenon in the condition of a lower frame frequency.

In the present invention, the PWM turn-on sub-sections are continuous for the neighboring pixels on the neighboring common electrodes along an identical segment electrode, and the PWM non-turn-on sub-sections are continuous for the neighboring pixels on the neighboring common electrodes along an identical segment electrode; the PWM turn-on sub-sections are discontinuous for the neighboring pixels on the neighboring segment electrodes along an identical common electrode, and the PWM non-turn-on sub-sections are discontinuous for the neighboring pixels on the neighboring segment electrodes along an identical common electrode. The space-related well-weighted PWM turn-on mode can reduce the switching frequency of the pixels. In such a method, as the PWM turn-on signals are discontinuous for the pixels of the neighboring segment electrodes, the crosstalk effect can be reduced. Thus, the output of the drive elements can be stabilized, the panel life can be prolonged, and the display quality can be promoted.

BRIEF DESCRIPTION OF THE DRAWINGS

FIG. 6 is a table showing the gray levels of the 16FRM+3PWM mode.

FIG. 7 is a table showing the gray levels of the 16FRM+4PWM mode.

DETAILED DESCRIPTION OF THE PREFERRED EMBODIMENTS

The technical contents of the present invention will be described in detail in cooperation with the drawings below.

Figure 1:
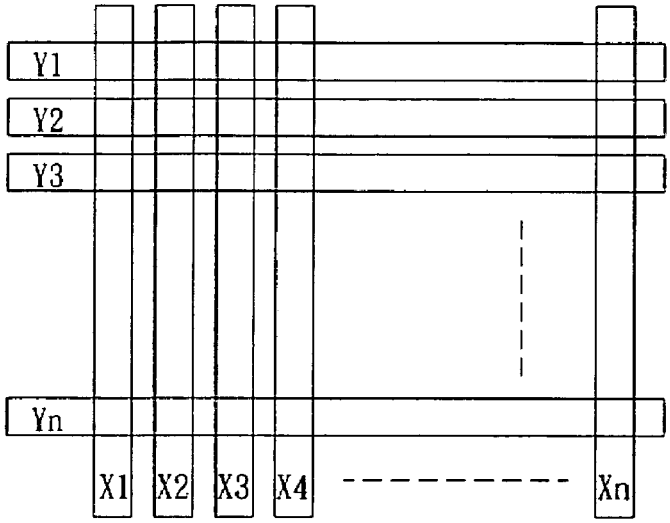
Fig. 1 PRIOR ART
FIG. 1 is a diagram schematically showing the electrodes of a general STN-LCD panel.
Figure 2:
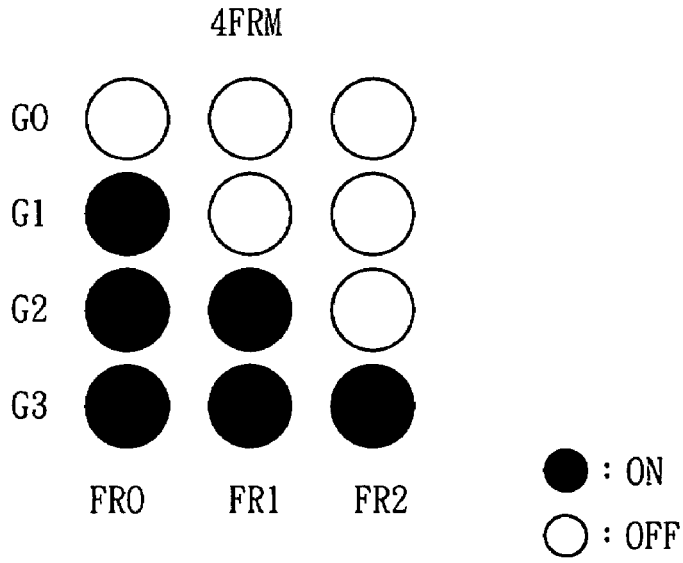
Fig. 2 PRIOR ART
FIG. 2 is a diagram showing the relation between the gray-level effects and the number of the turn-on frames.
Figure 3:
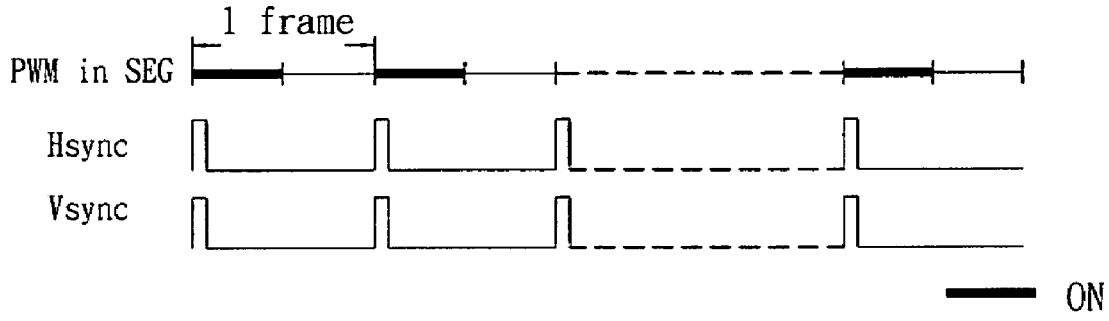
Fig. 3 PRIOR ART
FIG. 3 is a diagram schematically showing the signal of a general PWM mode.
Figure 4:
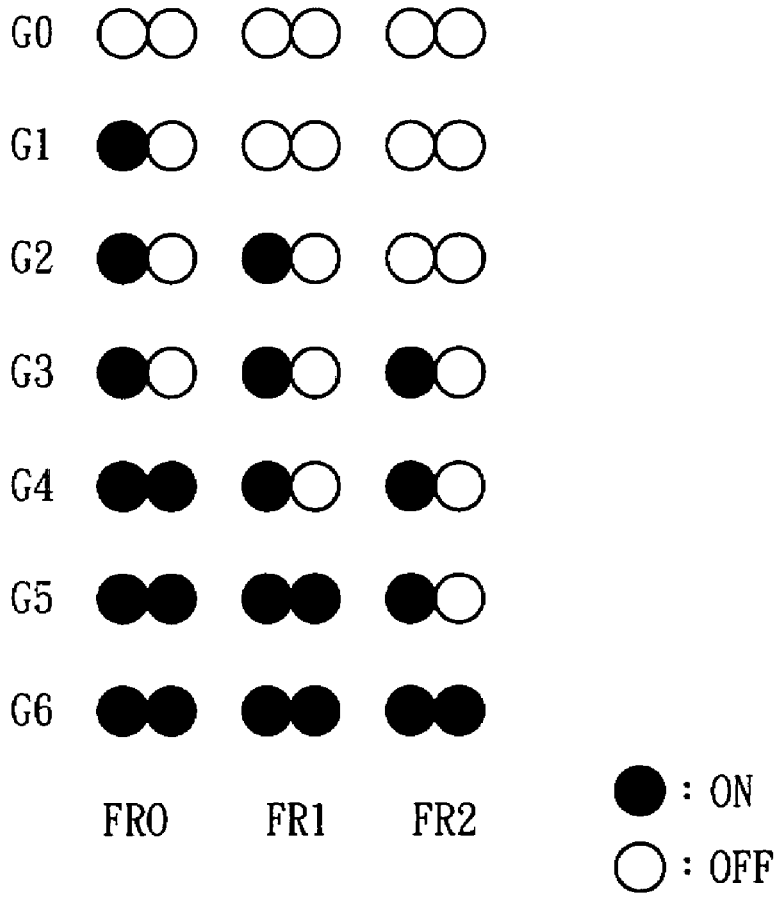
FIG. 4 is a diagram showing the relation between the gray-level effects and the number of the turn-on sub-sections under 4FRM+3PWM mode.

Refer to FIG. 4 a diagram showing the relation between the gray-level effects and the number of the turn-on sub-sections under the 4FRM+3PWM mode, wherein the PWM mode is added into the FRM mode. In the FRM mode, the gray level depends on the number of the turn-on frames among N frames per second. The principle of controlling the gray level via the FRM mode is to control the number of the turn-on frames per second of a pixel to determine the ratio of the turn-on frames to N frames per second; thus, the gray level is determined by the turn-on ratio. As shown in FIG. 2, when there are three frames per second, i.e. in the conventional 4FRM mode (4FRM—4 gray-level FRM mode), there are only four gray levels G0, G1, G2, and G3 corresponding to the combinations of the turn-on state and the non-turn-on state of frames FR0, FR1, and FR2. The PWM mode controls the gray level via adjusting the length of the turn-on period within each frame interval. In 3PWM mode, each frame interval is divided into two sub-sections; thus, according to the combination of the turn-on and non-turn-on states of those two sub-sections within a frame interval, a pixel may have three gray-level states: non-turn-on, half turn-on, and full turn-on. The present invention is to add the PWM mode to the FRM mode. As shown in FIG. 4, when the 3PWM mode is added into the 4FRM mode, i.e. under the 4FRM+3PWM mode, each pixel may have seven gray levels G0, G1, G2, G3, G4, G5 and G6.

Figure 5:
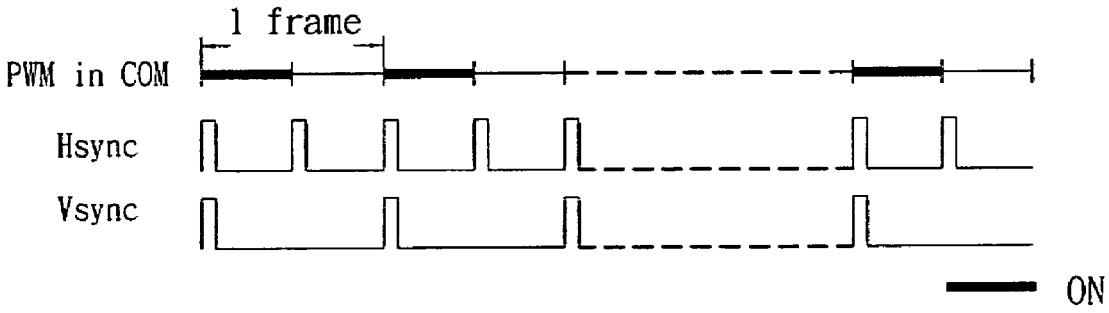
FIG. 5 is a diagram schematically showing the signal of the PWM mode of the present invention.

Refer to FIG. 5 a diagram schematically showing the signals of the PWM mode. In the present invention, the PWM mode is implemented with the common drive circuit, which scans the Y-direction electrodes; the segment drive circuit sends different voltages to the X-direction electrodes according to the data coming from the LCD control circuit. Originally, in a frame interval, there are only one Hsync (horizontal synchronous signal) section and one Vsync (vertical synchronous signal) section. In the present invention, an Hsync section is adjusted and divided into multiple sub-sections according to the requirement of the PWM mode. For example, in the 3PWM mode, an Hsync section of a frame interval is divided into two sub-sections. The division of the Hsync sections of the PWM mode can be implemented via just modifying the LCD control circuit, wherein the common signal of the LCD control circuit is adjusted to vary the length of the turn-on period within a frame interval. In the present invention, it is unnecessary to change the LCD drive circuit.

As shown in FIG. 6, based on the principle mentioned above, the 16FRM+3PWM mode of the present invention has 31 gray levels, which almost double the 16 gray levels of the conventional 16FRM mode. Further, as shown in FIG. 7, the 16FRM+4PWM mode of the present invention has 46 gray levels, which almost triple the 16 gray levels of the conventional 16FRM mode.

Figure 8:
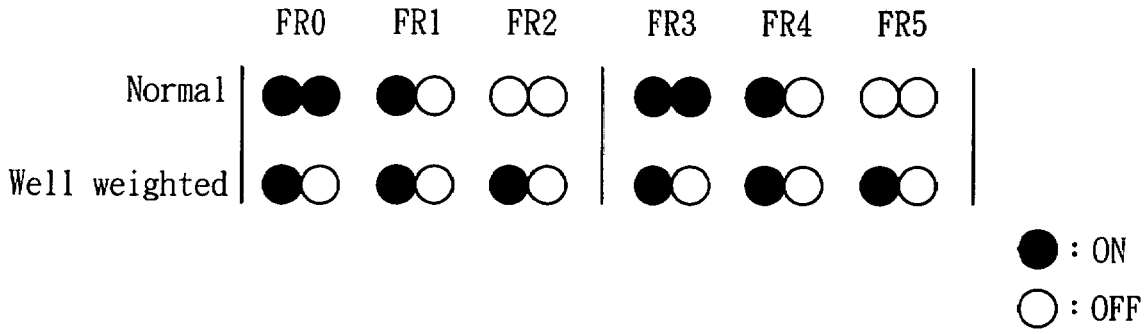
FIG. 8 is a diagram schematically showing the dispersion of the turn-on sub-sections in the PWM mode.

Refer to FIG. 8 a diagram schematically showing the dispersion of the turn-on sub-sections in the PWM mode. In the common 3PWM mode, for a series of frames FR0~FR5 of a pixel, the frame FR0, the front sub-section of the frame FR1, the frame FR3, and the front sub-section of the frame FR4 are turned on, as shown in the upper row of FIG. 8. Therefore, the rear sub-section of the frame FR1 and the frame FR2, i.e. ⅔ frame intervals, are non-turn-on. Another spirit of the present invention is to allocate the turn-on sub-sections to the neighboring non-turn-on frames via the LCD control circuit. As shown in the lower row of FIG. 8, the turn-on rear sub-section of the frame FR0 is allocated to the front sub-section of the frame FR2, and the turn-on rear sub-section of the frame FR3 is allocated to the front sub-section of the frame FR5. Thus, the turn-on sub-sections are well weighted, and the time length of a turn-on period and the time length of a non-turn-on period are both shortened, but the total time length of the turn-on sub-sections for a given number of frames is maintained to meet the required gray level. In comparison with the common PWM turn-on mode, the time-related well-weighted PWM turn-on mode of the present invention can have the speed faster than the photogene frequency of human eyes and reduce the flickering phenomenon in the condition of a lower frame frequency.

In order to reduce crosstalk effect, stabilize the output of the drive elements, prolong the life of the panel, and promote the display quality, the present invention utilizes the following method to configure the distribution of the PWM turn-on sub-sections on a panel. In this method, the PWM turn-on sub-sections are continuous for the neighboring pixels of the neighboring common electrodes along an identical segment electrode, and the PWM non-turn-on sub-sections are continuous for the neighboring pixels of the neighboring common electrodes along an identical segment electrode; the PWM turn-on sub-sections are discontinuous for the neighboring pixels of the neighboring segment electrodes along an identical common electrode, and the PWM non-turn-on sub-sections are discontinuous for the neighboring pixels of the neighboring segment electrodes along an identical common electrode. The abovementioned space-related well-weighted PWM turn-on mode can reduce the switching frequency of the pixels. In such a method, as the PWM turn-on signals are discontinuous for the pixels of the neighboring segment electrodes, the crosstalk effect can be reduced. Thus, the output of the drive elements can be stabilized, the panel life can be prolonged, and the display quality can be promoted.

Figure 9:
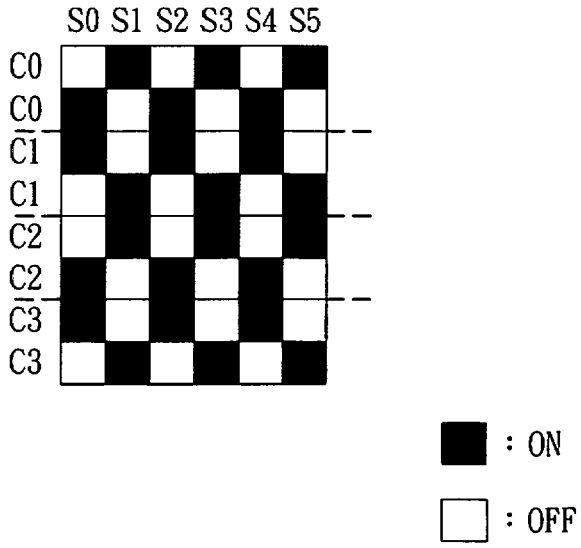
FIG. 9 is a diagram showing the allocation of the turn-on and non-turn-on sub-sections on a 6×4 panel under the 3PWM mode with ½ PMW density.

Refer to FIG. 9 a diagram showing the allocation of the turn-on and non-turn-on sub-sections on a 6×4 panel under the 3PWM mode with ½ PWM density, wherein 6 neighboring segment electrodes S0~S5 intersect 4 neighboring common electrodes C0~C3, and each frame interval has one Vsync section and two Hsync sub-sections. Along an identical segment electrode, the PWM turn-on sub-sections are continuous for the neighboring pixels on the neighboring common electrodes C0~C3, and the PWM non-turn-on sub-sections are continuous for the neighboring pixels on the neighboring common electrodes C0~C3. Along an identical common electrode, the PWM turn-on sub-sections are discontinuous for the neighboring pixels on the neighboring segment electrodes S0~S5, and the PWM non-turn-on sub-sections are discontinuous for the neighboring pixels on the neighboring segment electrodes S0~S5.

Figure 10:
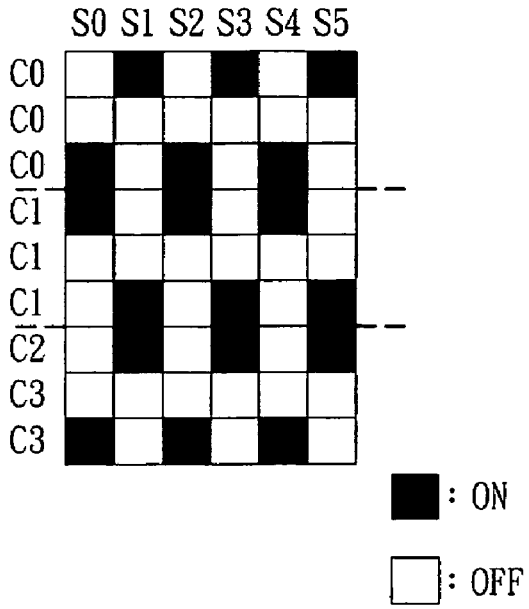
FIG. 10 is a diagram showing the allocation of the turn-on and non-turn-on sub-sections on a 6×3 panel under the 4PWM mode with ⅓ PMW density.
Figure 11:
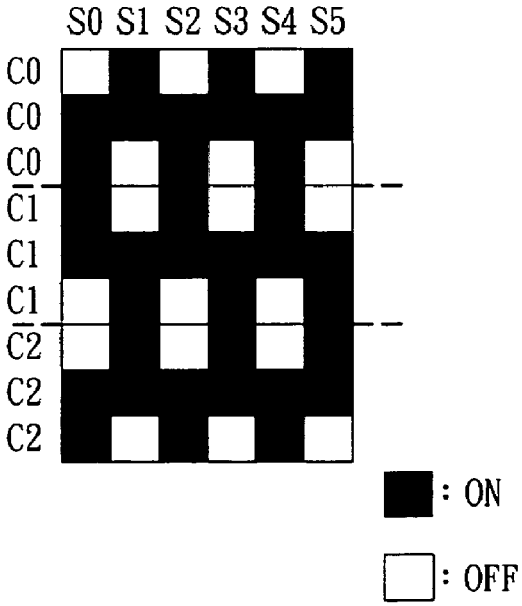
FIG. 11 is a diagram showing the allocation of the turn-on and non-turn-on sub-sections on a 6×3 panel under the 4PWM mode with ⅔ PMW density.

Refer to FIG. 10 for the allocation of the turn-on and non-turn-on sub-sections on a 6×3 panel under the 4PWM mode with ⅓ PMW density, wherein 6 neighboring segment electrodes S0~S5 intersect 3 neighboring common electrodes C0~C2, and each frame interval has one Vsync section and three Hsync sub-sections with the length of a Hsync sub-section ⅓ the length of a full Hsync section, and a turn-on unit occupies one Hsync sub-section. Refer to FIG. 11 for the allocation of the turn-on and non-turn-on sub-sections on a 6×3 panel under the 4PWM mode with ⅔ PMW density, wherein 6 neighboring segment electrodes S0~S5 intersect 3 neighboring common electrodes C0~C2, and each frame interval has one Vsync section and three Hsync sub-sections with the length of a Hsync sub-section ⅓ the length of a full Hsync section, and a turn-on unit occupies two Hsync sub-section.

In summary, the present invention increases the gray levels via adding the PWM mode into the FRM mode, and the PWM mode is implemented with the common drive circuit, which scans the Y-direction electrodes. A section of the horizontal synchronous signal Hsync is divided into multiple sub-sections according to the requirement of the PWM mode. In the present invention, the control of the length of the turn-on period within a frame interval can be achieved via only redesigning the LCD control circuit, and none special LCD drive circuit is needed.

Further, the present invention allocates the turn-on sub-sections to the neighboring non-turn-on frames via the LCD control circuit. Under the same gray level, the lengths of the turn-on periods and the non-turn-on periods are both shortened so that the display speed can be faster than the photogene frequency, and the flickering phenomenon can be reduced.

Furthermore, in the present invention, the turn-on sub-sections are continuous for the neighboring pixels on the neighboring common electrodes and along an identical segment electrode, and the non-turn-on sub-sections are continuous for the neighboring pixels on the neighboring common electrodes along an identical segment electrode. The turn-on sub-sections are discontinuous for the neighboring pixels on the neighboring segment electrodes and along an identical common electrode, and the non-turn-on sub-sections are discontinuous for the neighboring pixels on the neighboring segment electrodes along an identical common electrode. Thus, the switching frequency of the pixels can be reduced. As the turn-on signals are discontinuous for the pixels of the neighboring segment electrodes, the crosstalk effect can be reduced so that the output of the drive elements can be stabilized, and the panel life can be prolonged, and the display quality can be promoted.

Those preferred embodiments described above are to clarify the present invention; however, it is not intended to limit the scope of the present invention, and any equivalent modification and variation according to the spirit of the present invention is to be also included within the scope the claims of the present invention.

What is claimed is:

1. A driving method for increasing gray level, applying to an FRM (Frame Rate Modulation) display panel, the method comprising:

dividing the section of the horizontal synchronous signal of a frame interval into multiple sub-sections, adding a PWM (Pulse Width Modulation) mode, and implementing said PWM mode with the common drive circuit;

wherein said PWM mode allocates said turn-on sub-sections of a frame to neighboring non-turn-on frames whereby said original continuous turn-on sub-sections are weighted and dispersed to said neighboring non-turn-on frames, the turn-on sub-sections are continuous for the neighboring pixels on neighboring common electrodes and along an identical segment electrode, and said non-turn-on sub-sections are continuous for the neighboring pixels on neighboring common electrodes and along an identical segment electrode, the switching frequency of said pixels being thereby reduced.

2. The driving method according to claim 1, wherein the total length of the turn-on sub-sections of a given number of frames is maintained to keep the original gray level required by a pixel.

3. The driving method according to claim 1, wherein said turn-on sub-sections are discontinuous for the neighboring pixels on neighboring segment electrodes and along an identical common electrode, and said non-turn-on sub-sections are discontinuous for the neighboring pixels on neighboring segment electrodes and along an identical common electrode so that crosstalk effect can be reduced.

* * * * *